US008608206B2

(12) United States Patent
Fedale, Sr. et al.

(10) Patent No.: US 8,608,206 B2
(45) Date of Patent: Dec. 17, 2013

(54) PIPE-SEALING COLLAR

(76) Inventors: Glenn F. Fedale, Sr., Wilmington, DE (US); Allen Fedale, Wilmington, DE (US); Glenn F. Fedale, Jr., Hockessin, DE (US)

( * ) Notice: Subject to any disclaimer, the term of this patent is extended or adjusted under 35 U.S.C. 154(b) by 0 days.

(21) Appl. No.: 13/298,375

(22) Filed: Nov. 17, 2011

(65) Prior Publication Data

US 2012/0126530 A1 May 24, 2012

Related U.S. Application Data

(60) Provisional application No. 61/414,611, filed on Nov. 17, 2010.

(51) Int. Cl.
*E04D 13/00* (2006.01)
*E04G 15/06* (2006.01)

(52) U.S. Cl.
USPC ..... 285/43; 285/4; 277/636; 52/219

(58) Field of Classification Search
USPC ..... 285/42–44, 4; 277/315, 634, 635, 636, 277/314, 602, 606; 174/153 G; 52/58, 198, 52/199, 105, 219
See application file for complete search history.

(56) References Cited

U.S. PATENT DOCUMENTS 549,352 A 11/1895 Folger
839,106 A 12/1906 Buxton
2,054,308 A 9/1936 Tucker
RE26,026 E 5/1966 Dibley
3,313,559 A 4/1967 Kifer
3,677,576 A 7/1972 Gustafson
4,010,578 A 3/1977 Logsdon
4,160,347 A 7/1979 Logsdon
4,526,407 A 7/1985 Kifer
4,864,782 A 9/1989 Hasty
4,903,997 A 2/1990 Kifer
4,928,443 A * 5/1990 Goodman et al. ..... 52/58
5,036,636 A 8/1991 Hasty
5,176,408 A 1/1993 Pederson
5,226,263 A 7/1993 Merrin et al.
5,245,804 A 9/1993 Schiedegger et al.
5,536,048 A 7/1996 Orr
5,694,724 A 12/1997 Santiago
5,703,154 A 12/1997 Davis et al.
5,946,863 A 9/1999 Bullard
6,752,176 B1 6/2004 Price et al.
6,892,499 B1 5/2005 Mayle
6,954,947 B1 10/2005 Williams, Jr.
7,441,381 B2 10/2008 Scheirer et al.
D585,968 S 2/2009 Elkins et al.
7,775,005 B2 8/2010 Johnston et al.

(Continued)

FOREIGN PATENT DOCUMENTS

FR 2686671 A1 * 7/1993

*Primary Examiner* — James Hewitt
*Assistant Examiner* — Jay R Ripley
(74) *Attorney, Agent, or Firm* — Whiteford, Taylor & Preston LLP; Gregory M. Stone

(57) ABSTRACT

The invention comprises a replacement collar for a roof vent pipe. The collar provides UV protection for an existing gasket or can be used as a separate installation. Preferably, the collar has a thicker gauge and includes a seal flange and pre-applied sealant. The collar is designed for universal application for all appropriate sizes of pipe with unique cut line indentations to enable correct trimming to selected size.

10 Claims, 4 Drawing Sheets

(56) References Cited

U.S. PATENT DOCUMENTS

2005/0150176 A1 7/2005 Erekson
2006/0130411 A1 6/2006 Edgar et al.
2007/0101664 A1* 5/2007 Hoy et al. ..... 52/198

* cited by examiner

PIPE-SEALING COLLAR

CROSS REFERENCE TO RELATED APPLICATION

This application is based upon and claims benefit of copending and co-owned U.S. Provisional Patent Application Ser. No. 61/414,611 entitled "Pipe Sealing Collar", filed with the U.S. Patent and Trademark Office on Nov. 17, 2010 by the inventors herein, the specification of which is incorporated herein by reference.

BACKGROUND OF THE INVENTION

1. Field of the Invention

This invention pertains to protection of roof components from the damaging effects of ultra violet rays from the sun, and, more particularly, a shield device for blocking out ultra violet rays from roof pipe flashing components that are susceptible to ultra violet ray damage.

2. Background

Roofing in general deals with first sealing a structure from moisture and second protecting the sealing material from damage caused by the sun's ultra violet rays. For example, the standard built up roof uses alternating layers of felt paper and tar (bitumen) with a final layer of pea gravel to protect the roofing material from the sun. In addition, the standard composition asphalt shingle has an outer layer of mineral granules to block out UV rays. Other materials such as paint, wood, aluminum, steel, copper, and UV resistant plastic, and rubber are also used for UV protection. However, UV protection has generally been ignored in the design and manufacture of modern pipe flashing that has elastomeric or caulking material as a seal between the flashing and the pipe.

Since the invention of the roof flashing with elastomeric collar, there has been a problem with the elastomeric portion of the flashing becoming brittle, cracking, peeling, and rotting away because of damage caused by the sun's ultra violet rays.

Although there have been many variations and improvements to roof pipe flashing such as Kifer (U.S. Pat. Nos. 4,526,407 and 4,903,997) and Hasty (U.S. Pat. No. 4,864,782), these variations deal with methods of manufacture. Other improvements such as Gustafson (U.S. Pat. No. 3,677,576), Logsdon (U.S. Pat. Nos. 4,010,578 and 4,160,347), and Merrin (U.S. Pat. No. 5,226,263) deal with forming a better watertight seal between the pipe and flashing. Even the collar for venting high efficiency furnaces, Orr (U.S. Pat. No. 5,536,048), which is designed to seal onto PVC pipe with PVC glue, ignores the fact that PVC glue breaks down in the sun.

Recently, plumbing material manufactures such as Oatey and IPS Corporation started marketing a pipe flashing repair collar, known as a rain collar. This collar is the elastomeric portion of their pipe flashing without the base. Placing the rain collar over the damaged pipe flashing makes the repair. In a similar case as pipe flashing, rain collars need protection from the sun.

SUMMARY

It is, therefore, an object of the present invention to provide a pipe-sealing collar that avoids the disadvantages of the prior art.

It is another object of the invention is to provide a pipe-sealing collar in the form of a device that can be attached to a pipe passing through a roof structure.

It is yet another object of the invention to provide a pipe-sealing collar that is inexpensive and of simplified construction so as to be commercially feasible.

A further object of the invention is to provide a pipe-sealing collar that can accommodate more than one pipe diameter. A related object of the invention is to provide a pipe-sealing collar having separable rings of appropriate diameters.

Another object of the invention is to provide a pipe-sealing collar having pre-applied sealant around its base.

Another object of the invention is to provide a pipe-sealing collar that provides protection against ultraviolet radiation.

Still another object of the invention is to provide a pipe-sealing collar that can be installed over an existing collar or that can be used for initial installation. A related object of the invention is to provide a pipe-sealing collar that is replaceable.

In accordance with the above objects, a pipe-sealing collar for a roof vent pipe is disclosed. The collar provides UV protection for an existing gasket or can be used as a separate installation. Preferably, the collar has a thicker gauge and includes a seal flange and pre-applied sealant. The collar is designed for universal application for all appropriate sizes of pipe with unique cut line indentations to enable correct trimming to selected size.

BRIEF DESCRIPTION OF THE DRAWINGS

The above and other features, aspects, and advantages of the present invention are considered in more detail, in relation to the following description of embodiments thereof shown in the accompanying drawings, in which.

DETAILED DESCRIPTION OF PREFERRED EMBODIMENTS

Figure 1:
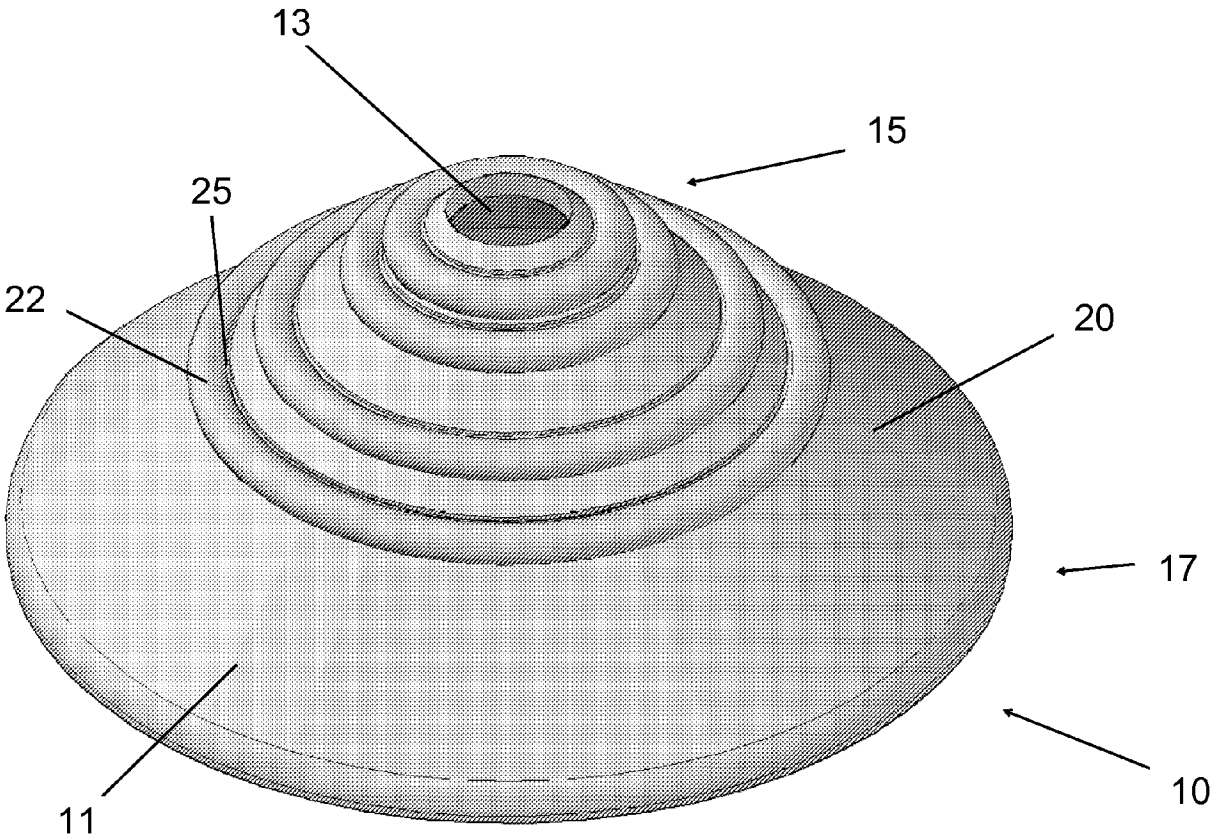
FIG. 1 is a perspective view of a pipe collar according to an embodiment of the present invention.
Figure 2:
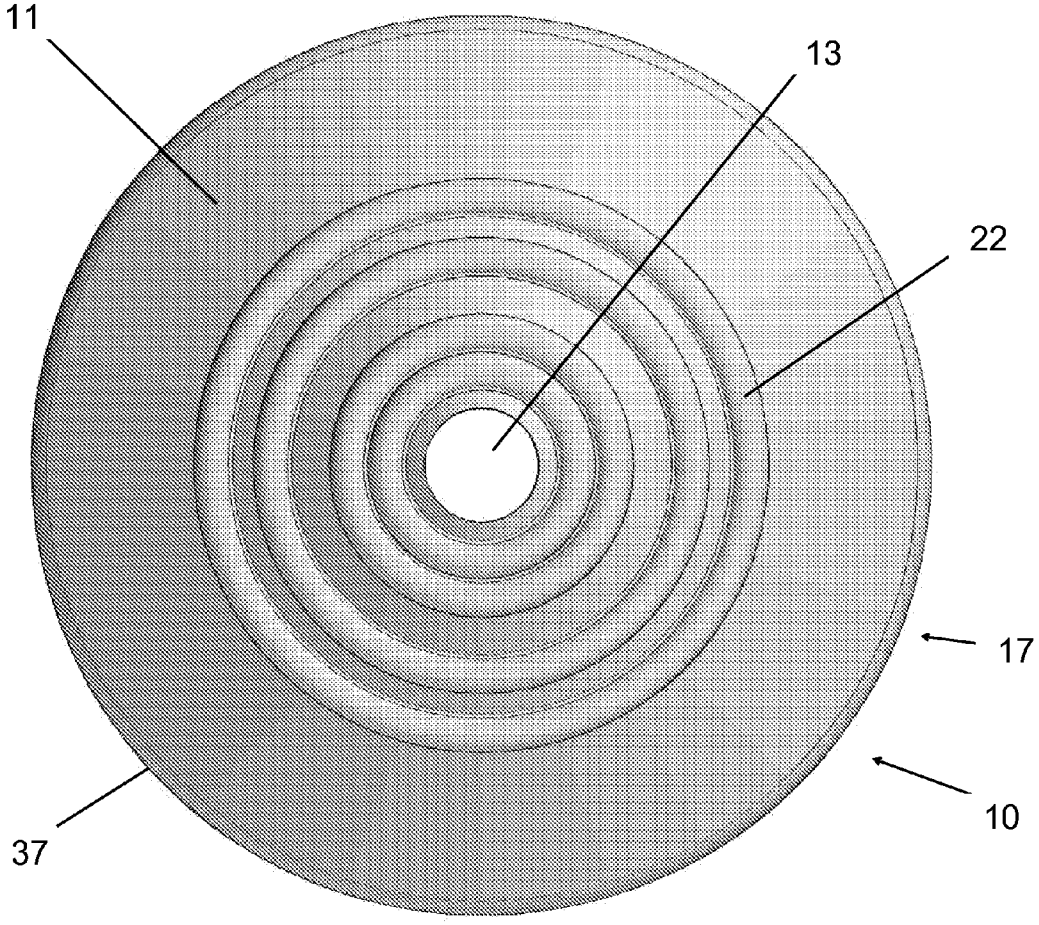
FIG. 2 is a top plan view of a pipe collar according to an embodiment of the present invention.
Figure 3:
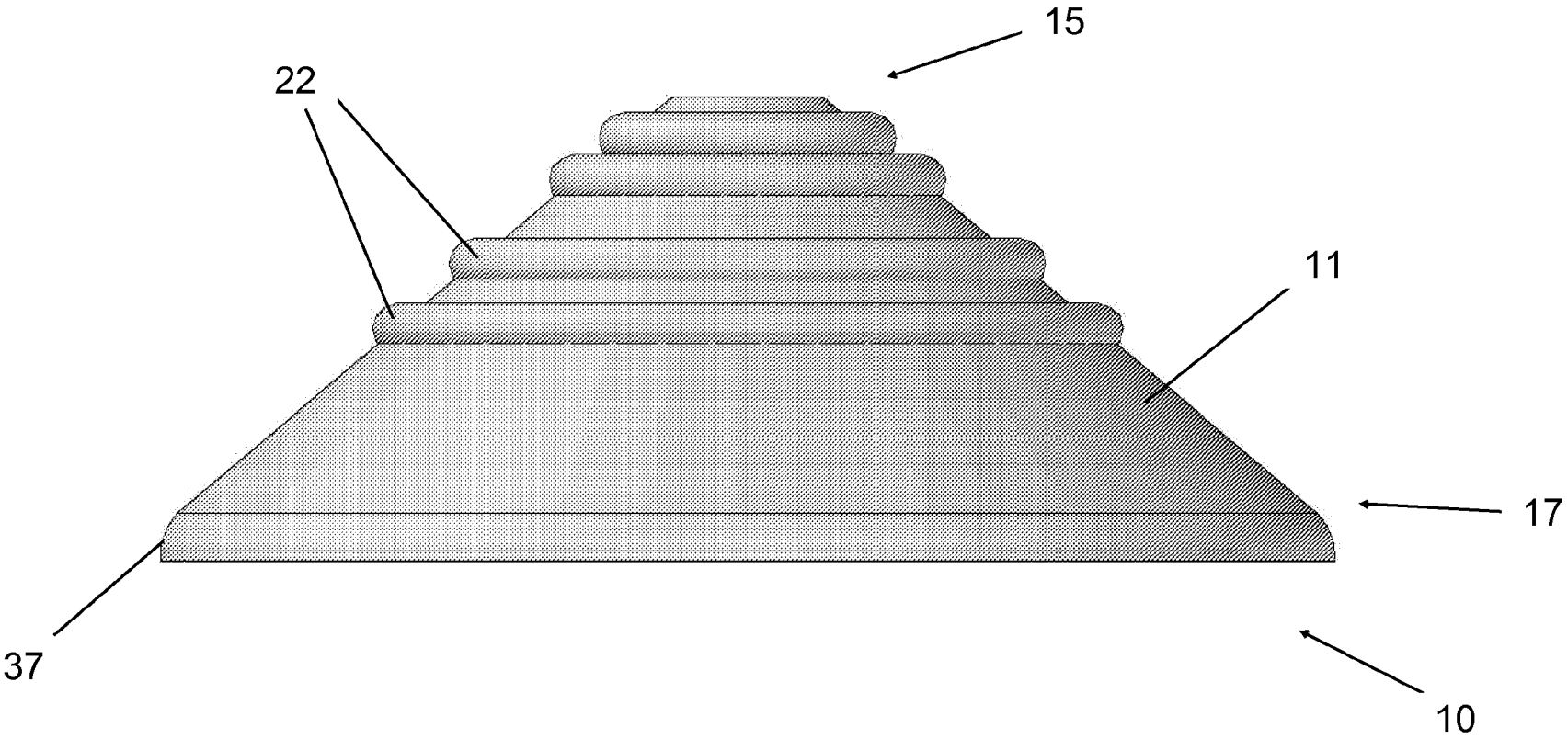
FIG. 3 is a side elevation view of a pipe collar according to an embodiment of the present invention.

The invention summarized above and defined by the enumerated claims may be better understood by referring to the following description, which should be read in conjunction with the accompanying drawings in which the same reference numbers are used for the same parts in the various views. This description of an embodiment, set out below to enable one to practice an implementation of the invention, is not intended to limit the preferred embodiment, but to serve as a particular example thereof. Those skilled in the art should appreciate that they may readily use the conception and specific embodiments disclosed as a basis for modifying or designing other methods and systems for carrying out the same purposes of the present invention. Those skilled in the art should also realize that such equivalent assemblies do not depart from the spirit and scope of the invention in its broadest form.

Referring to the drawings, the Figures show a pipe collar, indicated generally as 10, having a frustoconical, hollow shaped body 11 with an opening 13 at the top portion 15 and a substantially wider bottom portion 17 that is fully open. The body 11 has an inner surface 19 and an outer surface 20. In practice, the collar 10 is basically circular and symmetrical about a central vertical axis. Preferably, the collar 10 is manufactured of a resilient, rubber-like, elastomeric material approximately 0.125 inches thick that is resistant to damage from ultraviolet radiation. Such material may include neoprene, plastic, EPDM, among others. In a preferred embodiment, the material should meet ASTM, BOCA, and/or other building code standards.

Figure 4:
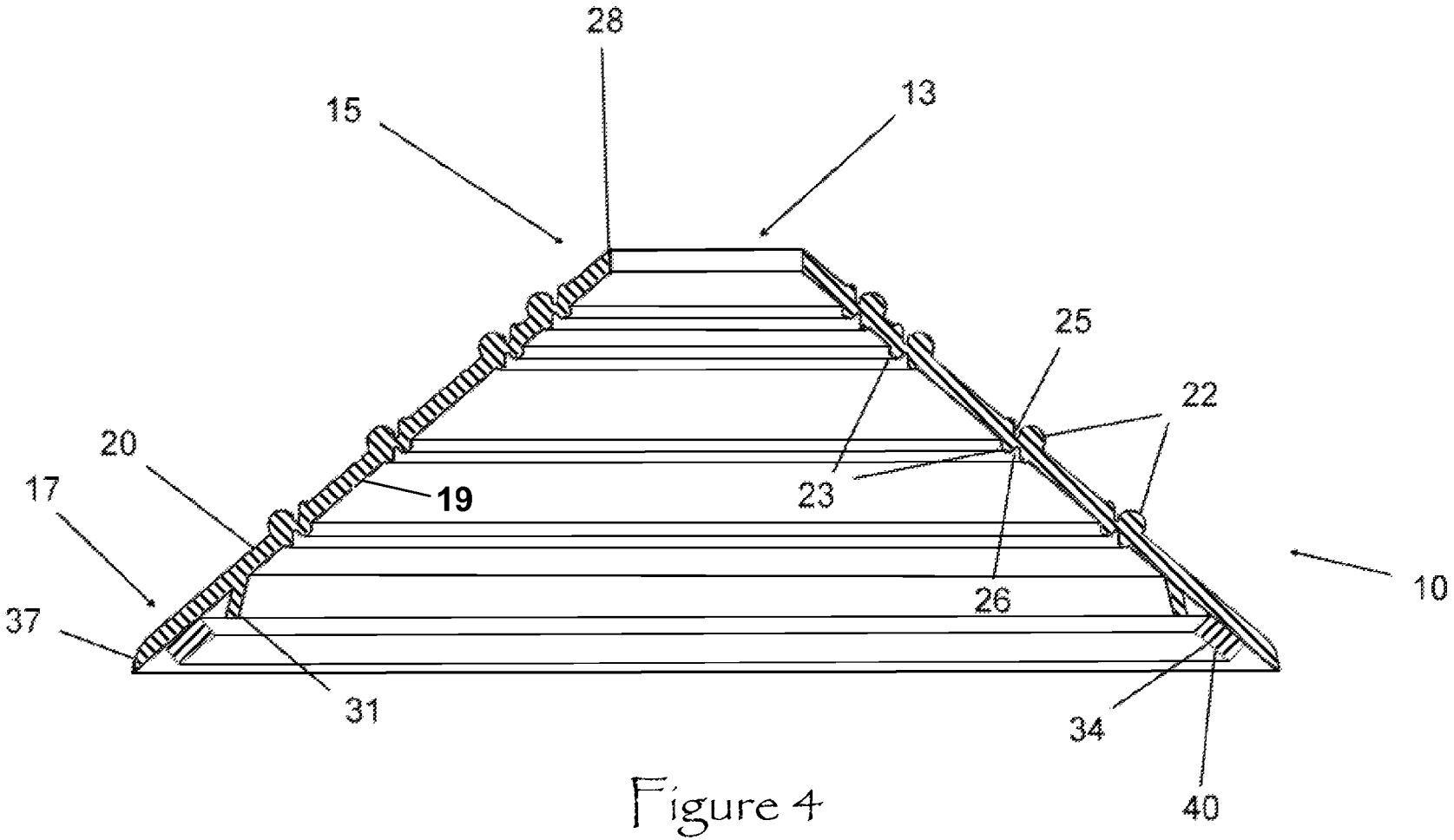
FIG. 4 is a cross sectional view of a pipe collar according to an embodiment of the present invention.

According to one embodiment, the pipe collar 10 includes a plurality of reinforcement rings 22 circumscribing the outer surface 20. Each ring 22 has a cut-line indentation 25 on one side of the reinforcement ring 22, on the side nearest the top portion 15 of the body 11. In some embodiments, the cut-line indentation 25 will be only on the outer surface 20 of the body 11. In some embodiments, the pipe collar 10 may include a plurality of ridges 23 circumscribing the inner surface 19. When the collar 10 includes a ridge 23, there should be a cut-line indentation 26 on the inner surface 19 of the body 11, adjacent to the ridge 23. It is contemplated that, in some embodiments, there may be both a cut-line indentation 25 on the outer surface 20 and a cut-line indentation 26 on the inner surface 19 of the body 11, such that the cut-line indentation 26 is directly below the cut-line indentation 25, as shown in FIG. 4. Preferably, the reinforcement rings 22 are positioned to enable a user to change the diameter of the opening 13 to conform to the diameter of a pipe on which the collar 10 is to be installed. In a preferred embodiment, the collar 10 will have sufficient rings 22 positioned at an appropriate diameter for every pipe size that is used for roof penetration. This feature enables a universal collar 10 to be used for all size applications.

Referring to FIG. 4, the inner wall 28 of the opening 13 should be substantially vertical with respect to the central axis of the collar 10. In use, any cut if necessary to adjust the diameter of the collar 10 should also be vertical at the appropriate cut line indentation 25 and/or 26.

A flange 31 may be provided on the inner surface 19 of the body 11. The flange 31 should circumscribe the bottom portion 17, extending downwardly and may be approximately a half-inch long. A pre-applied sealant 34 may also be provided on the inner surface 19 of the body 11. The sealant 34 should circumscribe the bottom portion 17, as near as practicable to the outer edge 37 of the body 11. Typically, the sealant 34 will be located closer to the outer edge 37 than the flange 31. In some embodiments, the sealant 34 will have a removable non-stick cover 40 for shipment. In use, the cover 40 should be removed during the installation process. The outer edge 37 of the collar 10 may be rounded or any appropriate shape.

The collar 10 of the present invention can be used as an original installation, as a replacement for an existing gasket, or as a protective cover for an existing gasket. In use, an installer would verify the diameter of the pipe on which the collar 10 is to be installed. If necessary, the installer can cut the collar 10 at an appropriate cut-line indentation 25 and/or 26 to fit the pipe. Preferably, the cut should be vertical with respect to the central axis of the collar 10. If present, the installer should remove the non-stick cover 40. The collar 10 is installed over the pipe and should form a tight seal against the pipe. Then, the installer should press the bottom portion 17 against the roof to ensure contact of the sealant 34 with the roof.

It will be appreciated by persons skilled in the art that numerous variations and/or modifications may be made to the invention as shown in the specific embodiments without departing from the spirit or scope of the invention as described. Having now fully set forth the preferred embodiments and certain modifications of the concept underlying the present invention, various other embodiments as well as certain variations and modifications of the embodiments herein shown and described will obviously occur to those skilled in the art upon becoming familiar with said underlying concept. It should be understood, therefore, that the invention might be practiced otherwise than as specifically set forth herein. The present embodiments are, therefore, to be considered in all respects as illustrative and not restrictive.

What is claimed is:

1. A roof pipe collar comprising:

a frusto-conical, hollow body having an inner surface and an outer surface;

said frusto-conical, hollow body having a central axis extending through said body that is vertical;

a circular opening at a top end of said body having a first diameter and defined by a vertical, circumferential wall extending from said inner surface to said outer surface;

an open bottom having a second diameter larger than said first diameter;

a plurality of upper vertical cut-line indentations extending vertically downward into said outer surface and circumscribing said outer surface, said plurality of upper vertical cut-line indentations having progressively increasing diameters from said circular opening at said top end of said body to said open bottom;

a plurality of lower vertical cut-line indentations extending vertically upward into said inner surface and circumscribing said inner surface, each said lower vertical cut-line indentation being vertically aligned with but not intersecting an upper vertical cut-line indentation and defining an aligned pair of upper and lower vertical cut-line indentations, and configured such that a vertical cut through said collar from said upper vertical cut-line indentation to said lower vertical cut-line indentation in a single aligned pair will produce a circular opening in said collar having a third diameter that is larger than said first diameter and smaller than said second diameter, and defining a second vertical, circumferential wall extending from said inner surface to said outer surface.

2. The pipe collar of claim 1, further comprising a semicircular ridge positioned on said inner surface adjacent to and radially inward from each said lower cut-line indentation.

3. The pipe collar of claim 1, wherein said body is symmetrical about said central vertical axis extending through said body from said top end to said open bottom.

4. The pipe collar of claim 1, wherein said body is manufactured of a resilient elastomeric material that is resistant to damage from ultraviolet radiation.

5. The pipe collar of claim 1, further comprising a plurality of reinforcement rings on said outer surface, each said reinforcement ring being positioned adjacent to and radially outward from each said upper vertical cut-line indentation.

6. The pipe collar of claim 5, further comprising a semicircular ridge positioned on said inner surface adjacent to and radially inward from each said lower cut-line indentation.

7. The pipe collar of claim 1, further comprising a flange extending downward from said inner surface of said body, said flange positioned radially inward from said open bottom and radially outward from an aligned pair of upper and lower vertical cut-line indentations that is closest to said open bottom.

8. The pipe collar of claim 7, wherein said flange is approximately ½ inch in length.

9. The pipe collar of claim 7, further comprising a sealant circumscribing said inner surface of said body and positioned radially outward from said flange.

10. The pipe collar of claim 9, wherein said sealant is covered by a removable non-stick cover.

* * * * *